US009423729B2

(12) United States Patent
Matsuno

(10) Patent No.: US 9,423,729 B2
(45) Date of Patent: Aug. 23, 2016

(54) IMAGE FORMING APPARATUS AND HEAT FIXING DEVICE PROVIDED IN THE SAME

(71) Applicant: Brother Kogyo Kabushiki Kaisha, Nagoya-shi, Aichi-ken (JP)

(72) Inventor: Takuji Matsuno, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/226,859

(22) Filed: Mar. 27, 2014

(65) Prior Publication Data

US 2014/0294419 A1 Oct. 2, 2014

(30) Foreign Application Priority Data

Mar. 28, 2013 (JP) ..... 2013-070014

(51) Int. Cl.
*G03G 15/20* (2006.01)

(52) U.S. Cl.
CPC ..... *G03G 15/2017* (2013.01); *G03G 15/2042* (2013.01); *G03G 15/2078* (2013.01); *G03G 15/2053* (2013.01); *G03G 2215/2035* (2013.01)

(58) Field of Classification Search
CPC ..... G03G 15/2017; G03G 15/2039; G03G 15/2053; G03G 15/2078; G03G 2215/2035
USPC ..... 399/69, 329
See application file for complete search history.

(56) References Cited

U.S. PATENT DOCUMENTS 6,519,426 B2 * 2/2003 Goto et al. ..... 399/69
6,647,217 B2 11/2003 Tomatsu
6,950,616 B2 9/2005 Saito et al.
7,620,338 B2 11/2009 Yamada et al.
7,907,870 B2 3/2011 Haseba et al.
8,027,607 B2 9/2011 Kurata et al.
8,346,106 B2 1/2013 Takenaka et al.
2002/0003970 A1 1/2002 Goto et al.
2003/0228179 A1 * 12/2003 Yaomin ..... G03G 15/2057 399/329
2004/0190924 A1 9/2004 Iwasaki et al.
2004/0197112 A1 * 10/2004 Saito et al. ..... 399/69
2005/0175367 A1 * 8/2005 Urabe ..... 399/69

(Continued)

FOREIGN PATENT DOCUMENTS

CN 1497390 A 5/2004
JP 2006-251068 A 9/2006

(Continued)

OTHER PUBLICATIONS

Jan. 28, 2015—(US) Non-Final Office Action—U.S. Appl. No. 14/226,841.

(Continued)

*Primary Examiner* — Benjamin Schmitt
(74) *Attorney, Agent, or Firm* — Banner & Witcoff, Ltd.

(57) ABSTRACT

An image forming apparatus includes an endless belt, a heater, a first temperature sensor, and a second temperature sensor. The endless belt is configured to circularly move about a rotational axis extending in an axial direction. The endless belt has a center portion and end portions in the axial direction, and defines an internal space and an outer peripheral surface. The heater is configured to heat the endless belt. The first temperature sensor is positioned at the center portion and in the internal space. The second temperature sensor is positioned at one of the end portions and facing the outer peripheral surface.

35 Claims, 11 Drawing Sheets

(56) References Cited

U.S. PATENT DOCUMENTS

| | | | | |
|---|---|---|---|---|
| 2007/0059001 | A1* | 3/2007 | Matsuura et al. | 399/45 |
| 2009/0052927 | A1* | 2/2009 | Yoshikawa | 399/69 |
| 2009/0110451 | A1* | 4/2009 | Jung | G03G 15/2064 399/329 |
| 2009/0175645 | A1* | 7/2009 | Seol | G03G 15/2039 399/69 |
| 2011/0020018 | A1 | 1/2011 | Takenaka et al. | |
| 2011/0150544 | A1* | 6/2011 | Ishida et al. | 399/328 |
| 2011/0158719 | A1 | 6/2011 | Miyauchi et al. | |
| 2012/0251138 | A1 | 10/2012 | Ishida et al. | |
| 2013/0034362 | A1* | 2/2013 | Matsuura et al. | 399/69 |
| 2014/0294417 | A1 | 10/2014 | Matsuno | |

FOREIGN PATENT DOCUMENTS

| | | | |
|---|---|---|---|
| JP | 2011-028037 | A | 2/2011 |
| JP | 2011-113016 | A | 6/2011 |
| JP | 2012-133281 | A | 7/2012 |

OTHER PUBLICATIONS

Jun. 10, 2015—(US) Final Office Action—U.S. Appl. No. 14/226,841.

Oct. 10, 2015—(CN) Notification of First Office Action—App 201410120590.1, Eng Tran.

Nov. 2, 2015—(CN) Notification of First Office Action—App 201410119548.8, Eng Tran.

Jun. 13, 2016—(CN) Notification of Second Office Action—App 201410119548.8, Eng Tran.

Jun. 7, 2016—(CN) Notification of Second Office Action—App 201410120590.1, Eng Tran.

* cited by examiner

IMAGE FORMING APPARATUS AND HEAT FIXING DEVICE PROVIDED IN THE SAME

CROSS REFERENCE TO RELATED APPLICATION

This application claims priority from Japanese Patent Application No. 2013-070014 filed Mar. 28, 2013. The entire content of the priority application is incorporated herein by reference.

TECHNICAL FIELD

The present invention relates to a heat fixing device having a temperature sensor, and an image forming apparatus having the heat fixing device.

BACKGROUND

A heat fixing device provided in an image forming apparatus includes an endless belt having a center portion and end portions in an axial direction thereof, a heater disposed within the endless belt, and temperature sensors adapted to detect temperature of the endless belt.

SUMMARY

One of the temperature sensors is positioned at a center portion within the endless belt, and another of the temperature sensor is positioned at end portions within the endless belt. Thus, the temperature sensor can efficiently detect the temperature of center portion and end portions within the endless belt. However, a decrease in temperature at the end portions on an outer peripheral surface of the endless belt adversely affects an image quality of the image forming apparatus. Therefore, it is desired that the temperature at the end portions on the outer peripheral surface of the endless belt can precisely be detected.

In view of the foregoing, it is an object of the present invention to provide an image forming apparatus that can precisely detect a temperature at the end portions on an outer peripheral surface of an endless belt.

In order to attain the above and other objects, the present invention provides an image forming apparatus. The image forming apparatus may include an endless belt, a heater, a first temperature sensor, and a second temperature sensor. The endless belt may be configured to circularly move about a rotational axis extending in an axial direction. The endless belt may have a center portion and end portions in the axial direction, and defines an internal space therein and an outer peripheral surface. The heater may be configured to heat the endless belt. The first temperature sensor may be positioned at the center portion and in the internal space. The second temperature sensor may be positioned at one of the end portions and facing the outer peripheral surface.

According to another aspect, the present invention provides a heat fixing device. The heat fixing device may include an endless belt, a nip member, a first temperature sensor, and a second temperature sensor. The endless belt may be configured to circularly move about a rotational axis extending in an axial direction. The endless belt may have a center portion and end portions in the axial direction. The endless belt may define an internal space therein, an inner peripheral surface, and an outer peripheral surface. The nip member may be configured to contact the inner peripheral surface of the endless belt. The first temperature sensor may be positioned at the center portion and in the internal space so as to face the nip member. The second temperature sensor may be positioned at one of the end portions and facing the outer peripheral surface.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
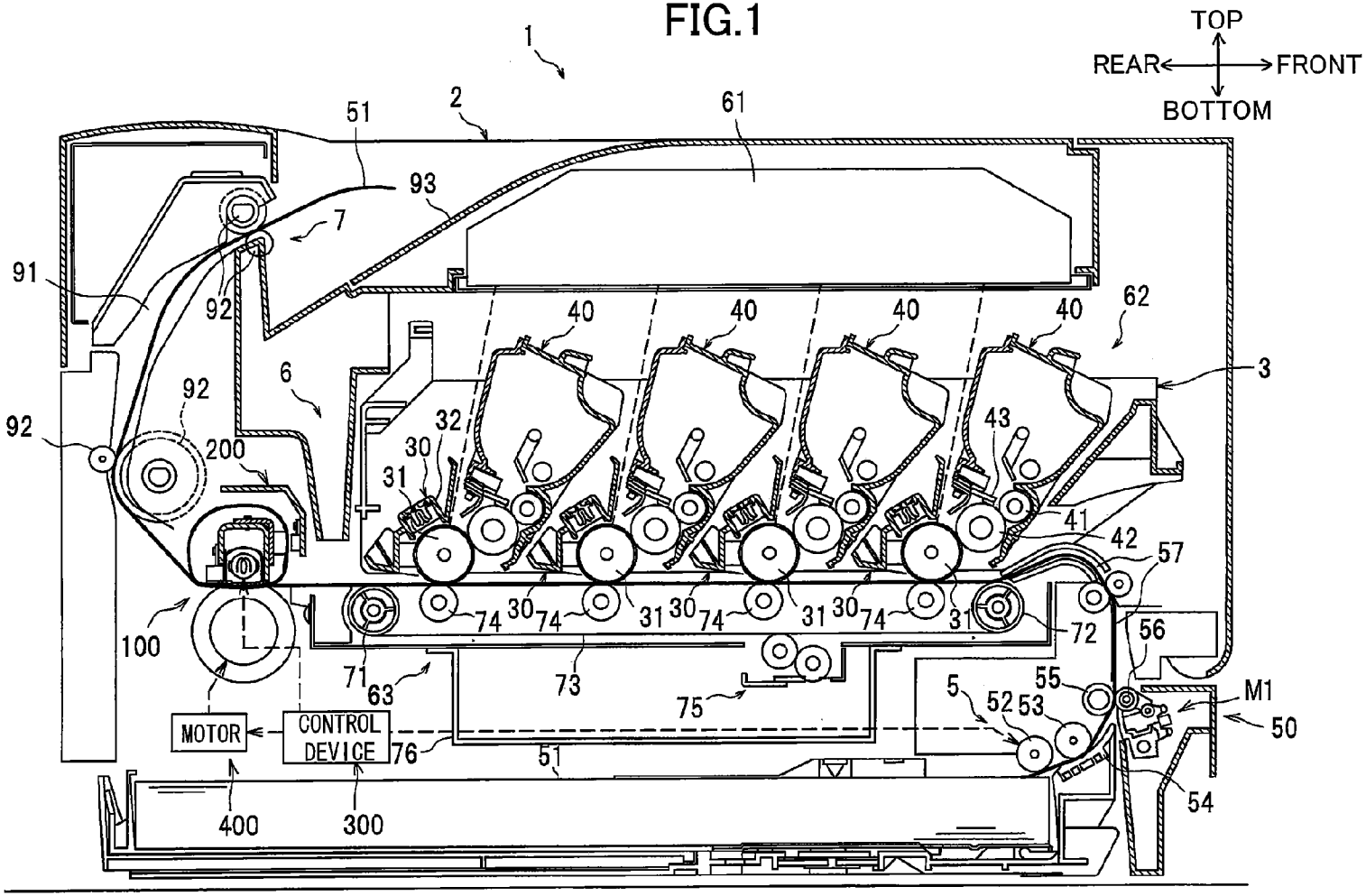
FIG. 1 is a schematic cross-sectional view of a color laser printer according to an embodiment of the invention.

An embodiment of the present invention will be described in detail with reference to the accompanying drawings. In the following description, the top-bottom direction shown in FIG. 1 is referred to as a top-bottom direction; the left side of FIG. 1 is referred to as a rear side, the right side as a front side, the far side of the sheet as a right side, and the near side of the sheet as a left side. In this case, the directions are defined based on directions as viewed from a front side of a color laser printer 1.

<Schematic Configuration of Color Laser Printer>

As shown in FIG. 1, the color laser printer 1 includes a device body 2, a paper feed unit 5 adapted to feed sheets 51, an image formation unit 6 adapted to form an image on the fed sheet 51, a paper discharge unit 7 adapted to discharge the sheet 51 on which the image has been formed, a control device 300; and a motor 400. These components are provided in the device body 2. The control device 300 and the motor 400 will be described later.

The paper feed unit 5 includes a paper feed tray 50 and a conveyance mechanism M1. The paper feed tray 50 is slidingly attached to and detached from the device body 2 from a front side at a lower portion of the device body 2. The conveyance mechanism M1 lifts up a front side of the sheet 51 from the paper feed tray 50 and conveys the sheet 51 so as to turn the sheet 51 rearward.

The conveyance mechanism M1 includes a pickup roller 52, a separation roller 53, and a separation pad 54, which are provided at a front end portion of the paper feed tray 50. Those components are adapted to separate one sheet 51 after another, and send the sheet 51 upward. As the sheet 51 that has been sent upward passes between a paper dust removing roller 55 and a pinch roller 56, paper dust is removed from the sheet 51. Subsequently, the sheet 51 travels along a conveyance route 57 while turning to the rear side. Then, the sheet 51 is fed onto a conveyance belt 73, and is conveyed to a fusing belt 110.

The image formation unit 6 includes a scanner unit 61, a process unit 62, a transfer unit 63, and a heat fixing device 100.

The device body 2 has an upper portion provided with the scanner unit 61 including a laser emitting unit, a polygon mirror, a plurality of lenses and reflective mirrors (not shown in the drawings). Laser beams for each of the colors, cyan, magenta, yellow, and black, are emitted from the laser emitting unit in the scanner unit 61, scans at high speed by the polygon mirror in a right-left direction, and then irradiates each photosensitive drum 31 after passing through or reflected by a plurality of lenses and reflective mirrors.

The process unit 62 is placed below the scanner unit 61 and above the paper feed unit 5. The process unit 62 includes a photosensitive unit 3 that is movable in a front-rear direction with respect to the device body 2. The photosensitive unit 3 includes four drum subunits 30 and developing cartridges 40. The drum subunits 30 are provided at a lower portion of the photosensitive unit 3, and each of the developing cartridges 40 is detachably mounted on each drum subunit 30.

Each drum subunit 30 includes a photosensitive drum 31 and a scorotron-type charger 32. Each developing cartridge 40 accommodates therein toner and includes a supply roller 41, a developing roller 42, and a layer thickness regulating blade 43.

The process unit 62 functions as described below. The supply roller 41 supplies the toner in the developing cartridge 40 to the developing roller 42. At this time, the toner is positively and frictionally charged between the supply roller 41 and the developing roller 42. The toner supplied to the developing roller 42 is regulated by the layer thickness regulating blade 43 as the developing roller 42 is rotated. As a result, the toner is curried on a peripheral surface of the developing roller 42 as a uniform thin layer.

The photosensitive drum 31 is uniformly and positively charged by corona discharge of the scorotron-type charger 32 in the drum subunit 30. The charged photosensitive drum 31 is irradiated with the laser beam emitted from the scanner unit 61 to form an electrostatic latent image corresponding to an image to be formed on the sheet 51 on the photosensitive drum 31.

Furthermore, as the photosensitive drum 31 rotates, the toner carried on the developing roller 42 is supplied to the electrostatic latent image of the photosensitive drum 31, e.g., to a portion of the surface of the positively charged photosensitive drum 31 whose potential is lowered due to the exposure of the laser beams. As a result, the electrostatic latent image of the photosensitive drum 31 is developed into a visible image, and a toner image is held on the peripheral surface of the photosensitive drum 31 for each color of the toner by reversal phenomena.

The transfer unit 63 includes a drive roller 71, a driven roller 72, an endless conveyance belt 73, transfer rollers 74, and a cleaning unit 75. The drive roller 71 and the driven roller 72 are separated in the front-rear direction, and are disposed parallel to each other. The conveyance belt 73 is looped around the drive roller 71 and the driven roller 72. The conveyance belt 73 has an outer surface in contact with each photosensitive drum 31. The conveyance belt 73 defines an internal space therein provided with the transfer rollers 74 so that the conveyance belt 73 is sandwiched between the photosensitive drum 31 and the transfer roller 74. The transfer rollers 74 are applied with a transfer bias from a high-voltage board not shown in the drawings. During the formation of the image, the sheet 51 conveyed by the conveyance belt 73 is held between the photosensitive drums 31 and the transfer rollers 74, and the toner images on each of the photosensitive drums 31 are transferred and superimposed onto the sheet 51.

The cleaning unit 75 is placed below the conveyance belt 73. The cleaning unit 75 removes the toner adhering to the conveyance belt 73, and collects the removed toner into a toner storage unit 76 disposed below the cleaning unit 75.

The heat fixing device 100 is provided rearward of the transfer unit 63. The heat fixing device 100 thermally fixes on the sheet 51 the toner images that have been transferred onto the sheet 51. The heat fixing device 100 will be described later.

The paper discharge unit 7 defines a discharge path 91 of the sheet 51 extending from an outlet of the heat fixing device 100 toward upward and then turning frontward. A plurality of conveyance rollers 92 is disposed in the middle of the discharge path 91 to carry the sheets 51. A paper discharge tray 93 is formed on an upper surface of the device body 2. The sheet 51 discharged by the conveyance rollers 92 from the discharge path 91 is stacked on the paper discharge tray 93.

<Detailed Configuration of Heat Fixing Device>

Figure 2:
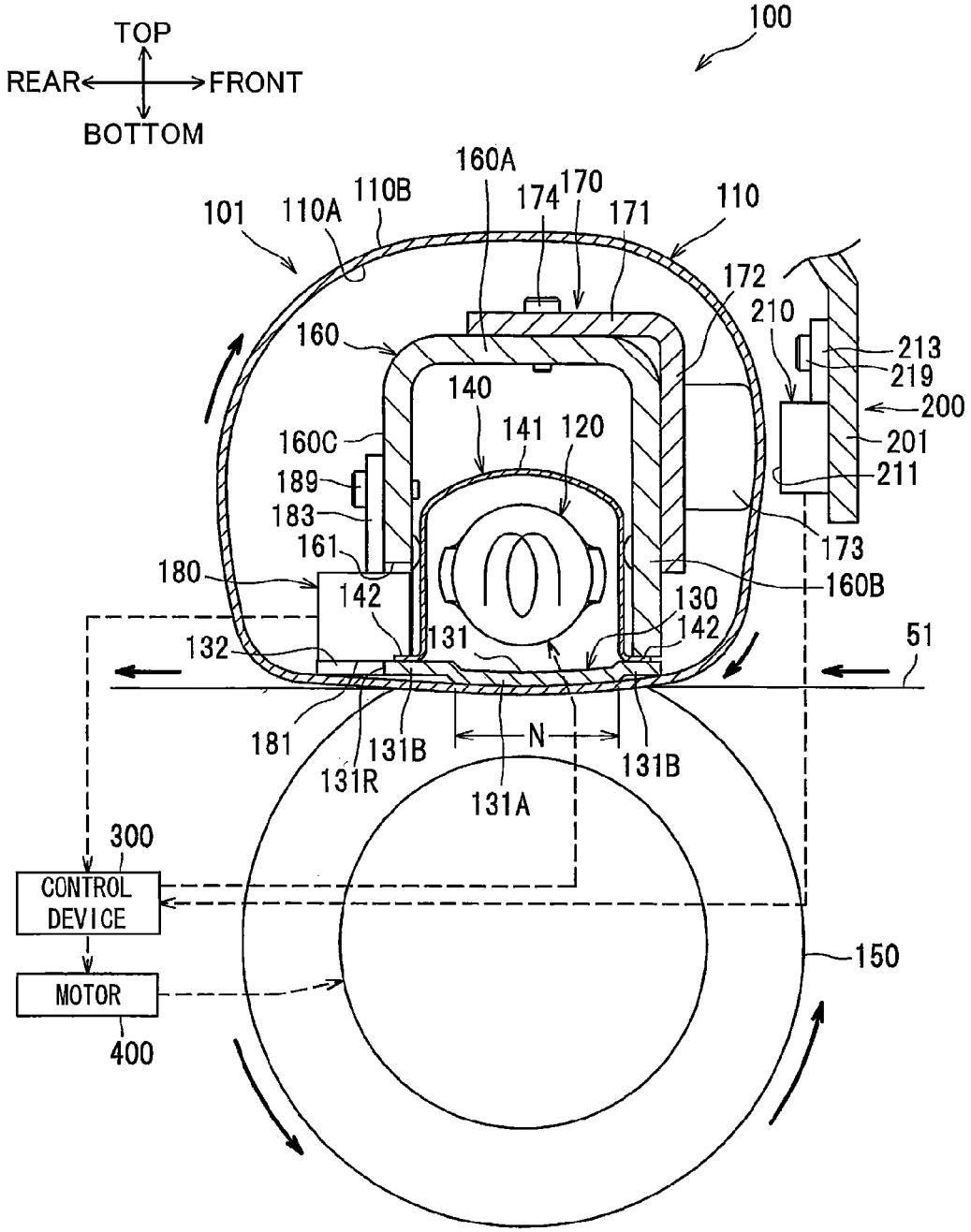
FIG. 2 is a schematic cross-sectional of a heat fixing device of the color laser printer.

As shown in FIG. 2, the heat fixing device 100 includes a heating member 101, a pressure roller 150 as an example of a rotation member, a fixing frame 200, and a pair of side thermistors 210 as an example of a second temperature sensor and a third temperature sensor.

Figure 3:
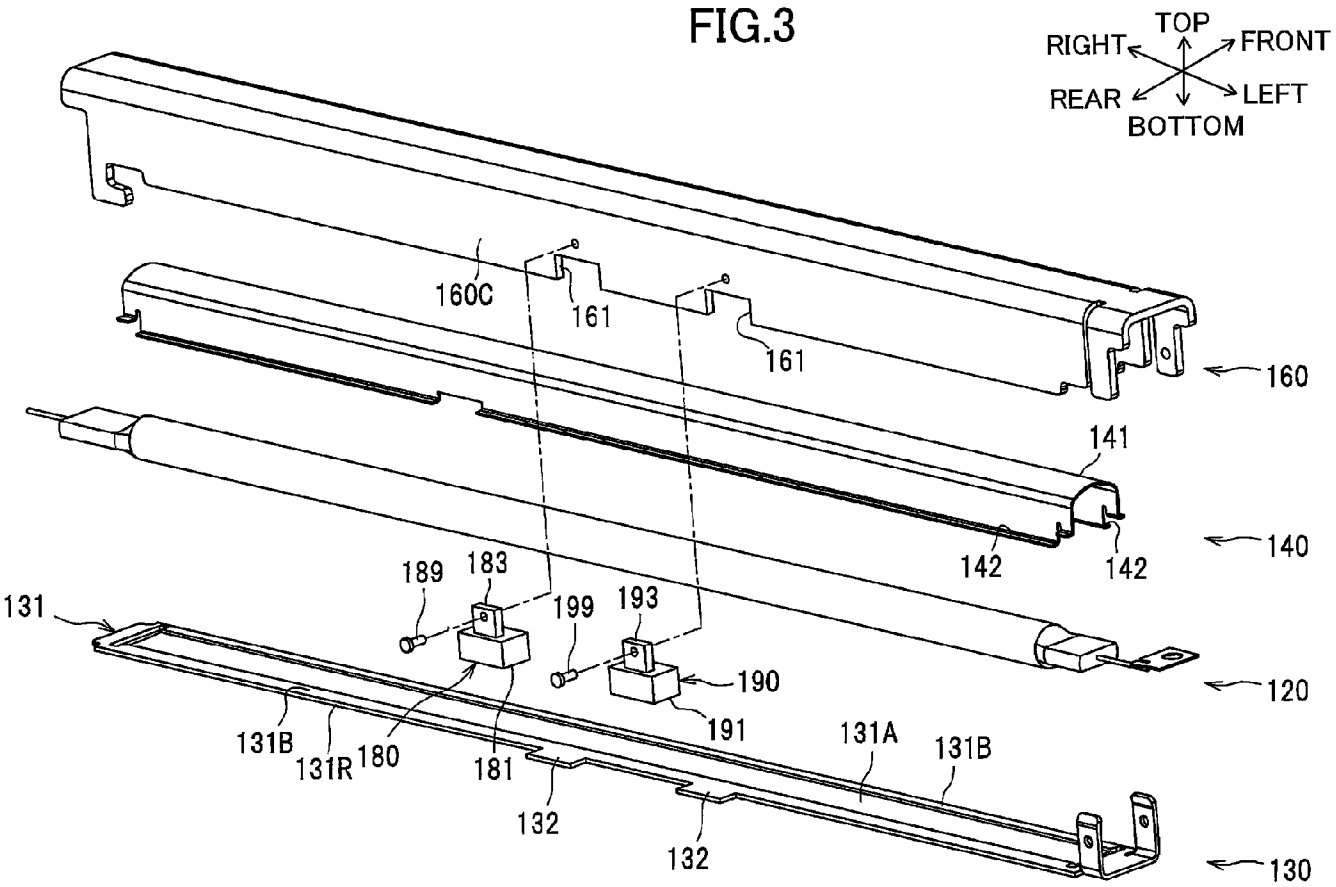
FIG. 3 is an exploded perspective view of a halogen lamp, a nip plate, a reflective plate, a stay, a center thermistor, and a thermostat.

The heating member 101 includes a fusing belt 110 as an example of an endless belt, a halogen lamp 120 as an example of a heater, a nip plate 130 as an example of a nip member, a reflective plate 140, a stay 160, a cover member 170, a center thermistor 180 as an example of a first temperature sensor, and a thermostat 190 as an example of an overheat prevention member (See FIG. 3).

The fusing belt 110 is an endless belt having heat resistance and flexibility and defines an internal space therein in which above components are disposed. The fusing belt 110 contacts the pressure roller 150 so as to follow the same, thereby circularly moving in the clockwise direction in FIG. 2, i.e. moving rearward at a nip N described later. The fusing belt 110 rotates about an axis extending in the right-left direction, and has an inner peripheral surface 110A in sliding contact with the nip plate 130 and an outer peripheral surface 110B in sliding contact with the pressure roller 150. The fusing belt 110 comprises a metal element tube made of stainless steel or the like. The fusing belt 110 may include a rubber layer covering a surface of the metal element tube, and may further include a non-metallic mold release layer such as fluorine coating for covering a surface of the rubber layer.

The halogen lamp 120 is a separate member from the nip plate 130. The halogen lamp 120 functions as a heating body for heating the toner on the sheet 51 by heating the nip plate 130 and the fusing belt 110. The halogen lamp 120 is disposed in the internal space of the fusing belt 110 with a predetermined gap from inner peripheral surface 110A of the fusing belt 110 and the nip plate 130, i.e., separated from the inner peripheral surface 110A of the fusing belt 110 and the nip plate 130.

The nip plate 130 is a plate-like member for receiving radiation heat from the halogen lamp 120, and is in sliding contact with the inner peripheral surface 110A of the fusing belt 110. The nip plate 130 transmits the radiation heat received from the halogen lamp 120 to the toner on the sheet 51 via the fusing belt 110. The nip plate 130 is made of, for example, an aluminum plate having larger thermal conductivity than the stay 160 made of steel. The nip plate 130 mainly includes a base section 131 and protruding sections 132 shown in FIG. 3.

The base section 131 has a central section 131A and end portions 131B in a conveyance direction of the sheet 51. The central section 131A has a convex shape protruding from both end portions 131B toward the pressure roller 150.

The protruding sections 132 protrude rearward from a rear end 131R of the base section 131 in the conveyance direction. As shown in FIG. 3, two protruding sections 132 are formed in the nip plate 130. Specifically, one protruding section 132 is formed at a center portion of the rear end 131R in the right-left direction, and another of the protruding section 132 is formed at a position slightly closer to the left side than the center portion in the right-left direction.

As shown in FIG. 2, the reflective plate 140 is a member adapted to reflect the radiation heat mainly emitted from the halogen lamp 120 in the front-rear direction and top direction to the nip plate 130, e.g., an inner surface of the base section 131. The reflective plate 140 is disposed in the internal space of the fusing belt 110 so as to surround the halogen lamp 120 with a predetermined gap therebetween.

The reflective plate 140 concentrates the radiation heat from the halogen lamp 120 on the nip plate 130. Therefore, the radiation heat from the halogen lamp 120 can be efficiently utilized, allowing the nip plate 130 and the fusing belt 110 to be quickly heated.

The reflective plate 140 is formed by bending, for example, an aluminum plate having a high reflectance to infrared rays and far infrared rays or any other plate into an almost U-shape in cross-section. More specifically, the reflective plate 140 mainly includes a reflective section 141 having a curved shape (substantially U-shape in cross-section) and flange sections 142 outwardly extending from both end portions of the reflective section 141 in the front-rear direction. The reflective plate 140 may be made from a mirror-finished aluminum plate to increase heat reflectance.

The stay 160 is a member that enhances the rigidity of the nip plate 130 by supporting both end portions 131B of the base section 131 of the nip plate 130 through the flange sections 142 of the reflective plate 140. The stay 160 is so placed as to cover the reflective plate 140 from above. More specifically, the stay 160 has a U-shaped cross-section including an upper wall 160A, a front wall 160B, and a rear wall 160C. The upper wall 160A has a front end form which the front wall 160B extends downward and a rear end from which the rear wall 160C extends downward.

As shown in FIG. 3, the stay 160 is formed with two notches 161 on the rear wall 160C to allow the center thermistor 180 and the thermostat 190 to be placed therein with a gap therebetween. More specifically, the notches 161 are formed at positions corresponding to the two protruding sections 132 of the nip plate 130.

Figure 4A:
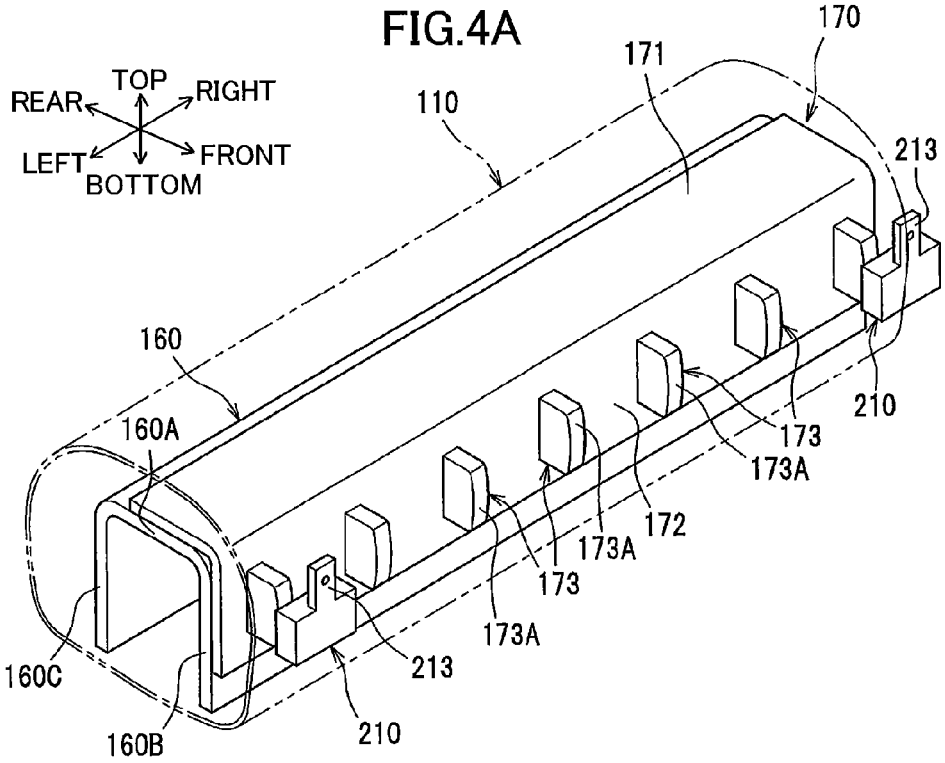
FIG. 4A is a schematic perspective view of the stay, a cover member, and side thermistors.
Figure 4B:
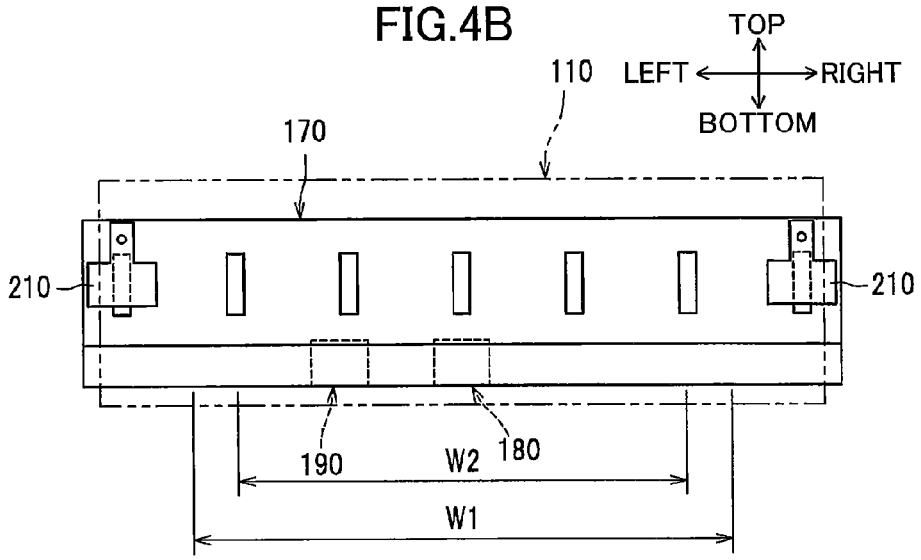
FIG. 4B is a front view of the stay, the cover member, and the side thermistors.

As shown in FIGS. 4A and 4B, the cover member 170 is disposed for covering the upper wall 160A and the front wall 160B of the stay 160. The cover member 170 includes an upper-side wall 171 and a front-side wall 172 extending downward from a front end of the upper-side wall 171. The front-side wall 172A has a front surface provided with a plurality of ribs 173.

Seven ribs 173 in total are provided on the front surface of the front-side wall 172 in the right-left direction at equal intervals so as to protrude from the front surface of the front-side wall 172 toward the front side. Each rib 173 is formed into generally square shape and has a front surface as a guide surface 173A for guiding the inner peripheral surface 110A of the fusing belt 110. The both end ribs 173 of the plurality of ribs 173 are opposite to the side thermistors 210 with respect to the fusing belt 110.

As shown in FIGS. 2 and 3, the center thermistor 180 is contact-type thermistors, and is adapted to detect a temperature of the nip plate 130. More specifically, the center thermistor 180 is positioned at internal space of the center portion of the fusing belt 110, and is positioned inside of a minimum paper width W2 (See FIG. 4B) in the right-left direction. The center thermistor 180 is adapted to output a center temperature TC as signals to the control device 300. The center thermistor 180 has an upper portion provided with a fixing rib 183 protruding upward. The fixing rib 183 is fixed to the rear wall 160C of the stay 160 with a screw 189. The center thermistor 180 is disposed so as to face an upper surface of the protruding section 132 of the nip plate 130, and has a bottom surface as a temperature detection surface 181 for detecting a temperature in contact with the upper surface of the protruding section 132. The center thermistor 180 may be noncontact-type thermistors and be disposed away from the nip plate 130, or may be infrared sensors. The minimum paper width W2 is a minimum width of paper sheet that can be printed in the color laser printer 1.

The thermostat 190 is a temperature detection element using bimetal and is disposed so as to detect the temperature of the nip plate 130. More specifically, the thermostat 190 is placed in an area slightly closer to the left side than the center portion of the fusing belt 110 in the right-left direction, and is positioned an inner side of a minimum paper width W2 in the right-left direction (See FIG. 4B). The thermostat 190 has an upper portion provided with a fixing rib 193 protruding upward. The fixing rib 193 is fixed to the rear wall 160C of the stay 160 with a screw 199.

The thermostat 190 is disposed so as to face an upper surface of the protruding section 132 of the nip plate 130 and has a bottom surface as a temperature detection surface 191 in contact with the upper surface of the protruding section 132. The thermostat 190 is provided on a circuit that supplies power to the halogen lamp 120. If the thermostat 190 detects a temperature larger than or equal to a predetermined value, then the thermostat 190 interrupts the supply of power to the halogen lamp 120, thereby preventing an excessive rise in the temperature of the heat fixing device 100.

The pressure roller 150 is in sliding contact with the outer peripheral surface 110B of the fusing belt 110 so as to form the nip N therebetween. The pressure roller 150 is disposed immediately below the nip plate 130 and sandwiches the fusing belt 110 in cooperation with the nip plate 130.

The fixing frame 200 is disposed so as to cover the heating member 101 from diagonally upward and frontward of the same, as shown in FIG. 1. The fixing frame 200 has a front wall 201 in front of the heating member 101, and the front wall 201 is provided with the pair of side thermistors 210.

The pair of side thermistors 210 is a noncontact-type thermistor and has an upper portion provided with a fixing rib 213 extending upward. The fixing rib 213 is fixed to the front wall 201 of the fixing frame 200 with a screw 219. The pair of side thermistors 210 has a rear surface as a temperature detection surface 211 in confrontation with the outer peripheral surface 110B with a gap therebetween.

More specifically, as shown in FIGS. 2, 4A, and 4B, the temperature detection surface 211 of each of the pair of side thermistors 210 is disposed on a front side of the nip N, i.e. on an upstream side of the moving-direction (rotational direction) of fusing belt 110 relative to the nip N. The pair of side thermistors 210 faces the right and left end portions of the outer peripheral surface 110B of the fusing belt 110 in the right-left direction. The fact that the pair of side thermistors 210 faces the right and left end portions of the outer peripheral surface 110B of the fusing belt 110 means that the temperature detection surface 211 is close to the outer peripheral surface 110B capable of detecting the temperature of the outer peripheral surface 110B of the fusing belt 110.

The pair of side thermistors 210 is disposed on the outside of a maximum paper width W1 in the right-left direction. The pair of side thermistors 210 may be a contact-type thermistor in direct contact with the fusing belt 110, or an infrared sensor. The pair of side thermistors 210 is adapted to respectively output end-portion temperatures TS as signals to the control device 300. The pair of side thermistors 210 and the center thermistors 180 may generate analog values corresponding to the temperatures, or generate digital values based on the analog values. The analog or digital values are transmitted to the control device 300 as signals. The maximum paper width W1 is a maximum width of paper sheet that can be printed in the color laser printer 1.

<Control Device>

The control device 300 will be described in detail. The control device 300 includes, for example, a storage unit having a CPU (Central Processing Unit), a ROM (Read Only Memory), and a RAM (Random Access Memory). The control device 300 is adapted to control the halogen lamp 120, the pickup roller 52, and the motor 400 by performing arithmetic process, based on previously prepared programs and the signals from each side thermistor 210 and the center thermistor 180. The signals may represent the temperatures acquired by the side thermistors 210 and the center thermistor 180. The ROM stores instructions for executing various control processes (described later) as programs. The CPU reads the instructions from the ROM, and performs various arithmetic processes.

The control device 300 controls the halogen lamp 120 based on signals from the center thermistor 180. For example, the control device 300 controls the halogen lamp 120 to maintain the output of the halogen lamp 120 constant until the center temperature TC obtained from the center thermistor 180 reaches a target temperature TH0. After the center temperature TC reaches the target temperature TH0, the control device 300 controls the halogen lamp 120 to maintain the center temperature TC at the target temperature TH0. The target temperature TH0 is a temperature within a range where a favorable heat fixing can be performed. The target temperature TH0 can be arbitrarily determined based on results of experiments or simulation. According to the present embodiment, TH0=180 degrees Celsius. The target temperature TH0 may be preferably any value within the range of 160 to 240 degrees Celsius, depending on characteristics of the heat fixing device 100, and be more preferably any value within the range of 175 to 200 degrees Celsius.

The control device 300 determines based on signals from each side thermistor 210 that a failure has occurred, i.e., an edge overheat has occurred, if the end-portion temperature TS obtained from at least one of side thermistors 210 is larger than or equal to a first temperature TH1 higher than the target temperature TH0. The first temperature TH1 is higher than temperatures at which the favorable fixing operation can be performed. The first temperature TH1 can be arbitrarily determined based on results of experiments or simulation. According to the present embodiment, TH1=220 degrees Celsius. The first temperature TH1 may be preferably any value within the range of 190 to 270 degrees Celsius, depending on characteristics of the heat fixing device 100, and be more preferably any value within the range of 200 to 230 degrees Celsius.

If the edge overheat has occurred, the control device 300 reduces the output of the halogen lamp 120. More specifically, the control device 300 reduces a duty ratio of pulse current supplied to the halogen lamp 120.

The control device 300 is configured to selectively perform either a first mode or a second mode as a print mode. When the edge overheat does not occur, the control device 300 performs the first mode in which a plurality of sheets 51 are supplied at first intervals T10. On the other hand, when the edge overheat occurs, the control device 300 performs the second mode in which a plurality of sheets 51 are supplied at second intervals T11 longer than the first intervals T10. That is, when the edge overheat occurs, the control device 300 controls the conveyance mechanism M1 to delay the conveyance timing of the sheets 51.

In the first mode, the time from the conveyance of the sheet 51 to the conveyance of the subsequent sheet 51 is set to the first interval T10. The first intervals T10 can be arbitrarily determined based on results of experiments, simulation, or the like.

In the second mode, the time from the conveyance of the sheet 51 to the conveyance of the subsequent sheet 51 is set to the second interval T11. More specifically, the control device 300 controls the conveyance mechanism M1 to convey the sheet 51 in the second mode after the second interval T11 has elapsed since the start of the conveying of the previous sheet 51. The second interval T11 is a period of time larger than or equal to the time required for the heat to be transferred from the right and left end portions of the fusing belt 110 toward the central portion thereof upon the occurrence of the edge overheat. The second interval T11 can be arbitrarily determined based on results of experiments or simulation. Incidentally, the control device 300 of the present embodiment is initially set in the first mode. When the edge overheat has occurred in the initial state or in the first mode, the control device 300 then changes the print mode from the first mode to the second mode.

The control device 300 control the motor 400 to be continuously turned ON, i.e., rotates the fusing belt 110 so as to follow the rotation of the pressure roller 150, and control the conveyance mechanism M1 not to supply the sheet 51 during the second interval T11 of the second mode. Therefore, when the edge overheat has occurred, the rotation of the fusing belt 110 has been continued to agitate the air, thereby dispersing the heat. The situation where the control device 300 controls the conveyance mechanism M1 not to supply the sheet 51 means the conveyance mechanism M1 suspends or forbids the supply of sheets 51 after the control device receives the print command.

When a sheet 51 having a width larger than or equal to a predetermined width W in the right-left direction is to be printed, the control device 300 determines whether the end-portion temperature TS obtained from at least one of side thermistors 210 is lower than or equal to a second temperature TH2 lower than the target temperature TH0 after a predetermined time T00 has elapsed since the halogen lamp 120 is turned ON. The second temperature TH2 is a temperature at which the favorable heat fixing cannot be performed. The second temperature TH2 can be arbitrarily determined based on results of experiments or simulation. The predetermined time T00 is, for example, the time required for the end-portion temperature TS and the center temperature TC to rise to the target temperature TH0 after the halogen lamp 120 is turned ON in a low-temperature environment. The predetermined time T00 can be arbitrarily determined based on results of experiments or simulation. The predetermined width W is larger than the minimum paper width W2 and smaller than the maximum paper width W1. According to the present embodiment, TH2=160 degrees Celsius. The second temperature TH2 may be preferably any value within the range of 130 to 200 degrees Celsius, depending on characteristics of the heat fixing device 100, and be more preferably any value within the range of 150 to 180 degrees Celsius.

If the end-portion temperature TS is lower than or equal to the second temperature TH2, the control device 300 increases the output of the halogen lamp 120. More specifically, the control device 300 increases a duty ratio of pulse current supplied to the halogen lamp 120.

When a sheet 51 having a width larger than or equal to the predetermined width W in the right-left direction is to be printed, the control device 300 determines whether the end-portion temperature TS obtained from at least one of side thermistors 210 is larger than or equal to a third temperature TH3 lower than the target temperature TH0 after the predetermined time T00 has elapsed since the halogen lamp 120 is turned ON. In this case, the third temperature TH3 of the present embodiment is a temperature within a range higher than the second temperature TH2 and slightly lower than the target temperature TH0. The third temperature TH3 can be arbitrarily determined based on results of experiments or simulation. The third temperature TH3 may be equal to the second temperature TH2. According to the present embodiment, TH3=170 degrees Celsius. The third temperature TH3 may be preferably any value within the range of 140 to 210 degrees Celsius, depending on characteristics of the heat fixing device 100, and be more preferably any value within the range of 160 to 190 degrees Celsius.

When the end-portion temperature TS is larger than or equal to the third temperature TS3, the control device 300 controls the conveyance mechanism M1 to start conveying a sheet 51, that is, the pickup roller 52 conveys the sheet 51.

Figure 5:
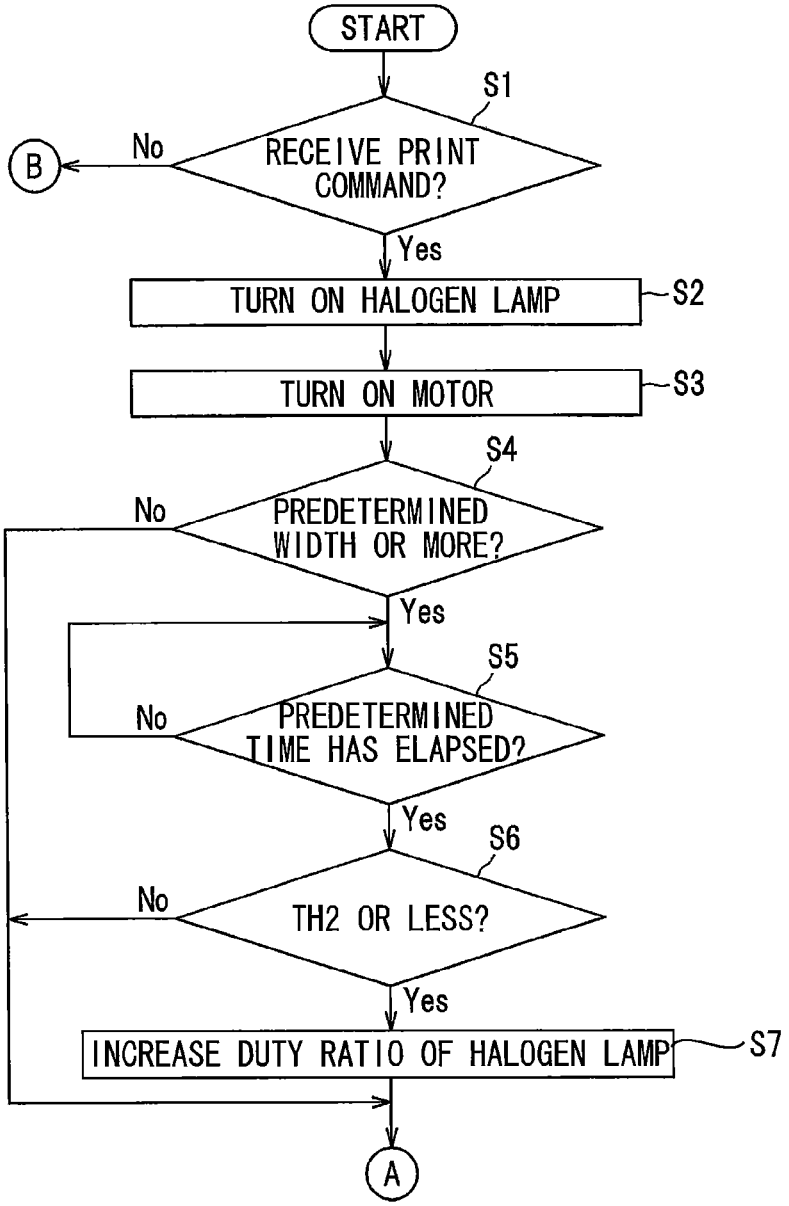
FIG. 5 is a flowchart illustrating an operation of a control device.
Figure 6:
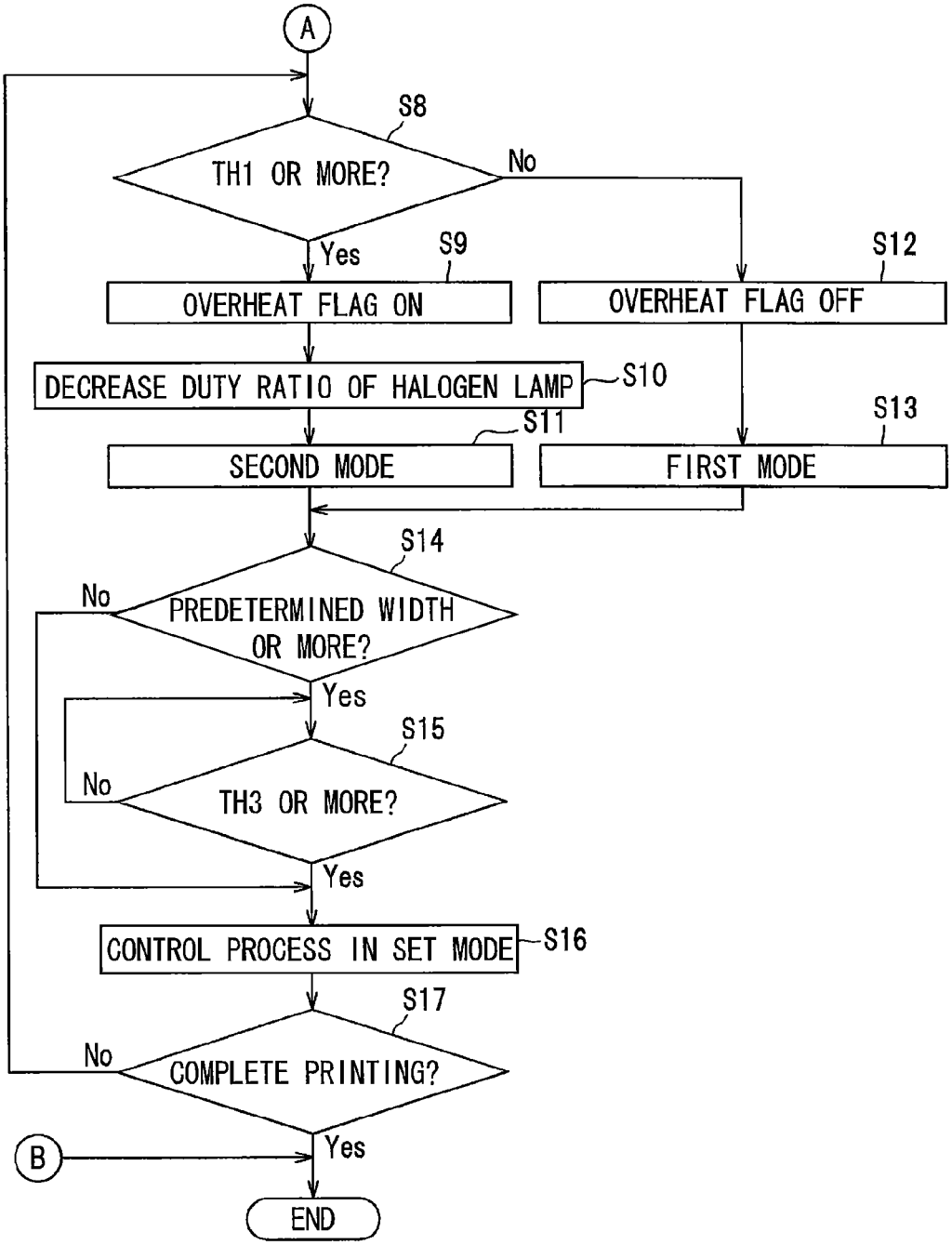
FIG. 6 is a flowchart illustrating the operation of the control device.

The control device 300 having the above configuration performs the control processes in accordance with a flowchart shown in FIGS. 5 and 6. The halogen lamp 120 is basically controlled by a normal control process in which the detection temperature of the center thermistor 180 is maintained substantially constant based on signals from the center thermistor 180. Upon starting a temperature control process shown in FIGS. 5 and 6 for controlling the halogen lamp 120, the temperature control process is applied instead of the normal control process. At the time of print operation, the process returns to the normal control process.

As shown in FIG. 5, the control device 300 determines whether to receive a print command (S1). If not (S1: No), then the control device 300 ends the temperature control process (See FIG. 6). If so (S1: Yes), the halogen lamp 120 is turned ON (S2), and then the motor 400 is turned ON after a predetermined small amount of time has elapsed from step S2 (S3). The output of the halogen lamp 120 at step S2 is smaller than a maximum output thereof.

After step S3, the control device 300 determines whether the width of the sheet 51 is larger than or equal to the predetermined width W (S4). If the width of the sheet 51 is larger than or equal to the predetermined width W (S4: Yes), then the control device 300 determines whether the predetermined time T00 of time has elapsed (S5). At step S5, if the predetermined time T00 of time has not elapsed (S5: No), the process of step S5 is repeatedly performed.

If the predetermined time T00 of time has elapsed (S5: Yes), the control device 300 determines whether the end-portion temperature TS is lower than or equal to the second temperature TH2 (S6). If the end-portion temperature TS is lower than or equal to the second temperature TH2 (S6: Yes), the control device 300 increases the duty ratio of pulse current supplied to the halogen lamp 120, i.e., the output of the halogen lamp 120 (S7).

If the width of the sheet 51 is not larger than or equal to the predetermined width W (S4: No), or if the end-portion temperature TS at step S6 is not lower than or equal to the second temperature TH2 (S6: No), or after the process of step S7 is performed, as shown in FIG. 6, the control device 300 determines whether the end-portion temperature TS is larger than or equal to the first temperature TH1 (S8).

At step S8, if the end-portion temperature TS is larger than or equal to the first temperature TH1 (S8: Yes), the control device 300 determines that the edge overheat has occurred, sets an overheat flag ON (S9), and then decreases the duty ratio of pulse current supplied to the halogen lamp 120 (S10). The control device 300 set the print mode to the second mode (S11).

In step S8, if the end-portion temperature TS is not larger than or equal to the first temperature TH1 (S8: No), the control device 300 sets the overheat flag OFF (S12) and sets the print mode to the first mode (S13).

After step S11 and step S13, the control device 300 determines whether the width of the sheet 51 is larger than or equal to the predetermined width W (S14). If the width of the sheet 51 is larger than or equal to the predetermined width W (S14: Yes), the control device 300 determines whether the end-portion temperature TS is larger than or equal to the third temperature TH3 (S15). If the end-portion temperature TS is not larger than or equal to the third temperature TH3 (S15: No), the control device 300 repeatedly performs step S15. If the end-portion temperature TS is larger than or equal to the third temperature TH3 (S15: Yes), the control device 300 performs a print control process in the print mode set in step S11 or S13 (S16). In step S16, one paper sheet is printed under the print control process among the paper sheets specified by the print command. In step S14, if the width of the sheet 51 is not larger than or equal to the predetermined width W (S14: No), the control device 300 performs the process of step S16 without carrying out the process of step S15.

After step S16, the control device 300 determines whether or not all sheets specified by the print command have been completely printed (S17). If the printing for the print command is not yet completed (S17: No), the control device 300 returns to the process of step S8. If the printing for the print command is completed (S17: Yes), the control device 300 ends the print control process.

Figure 7:
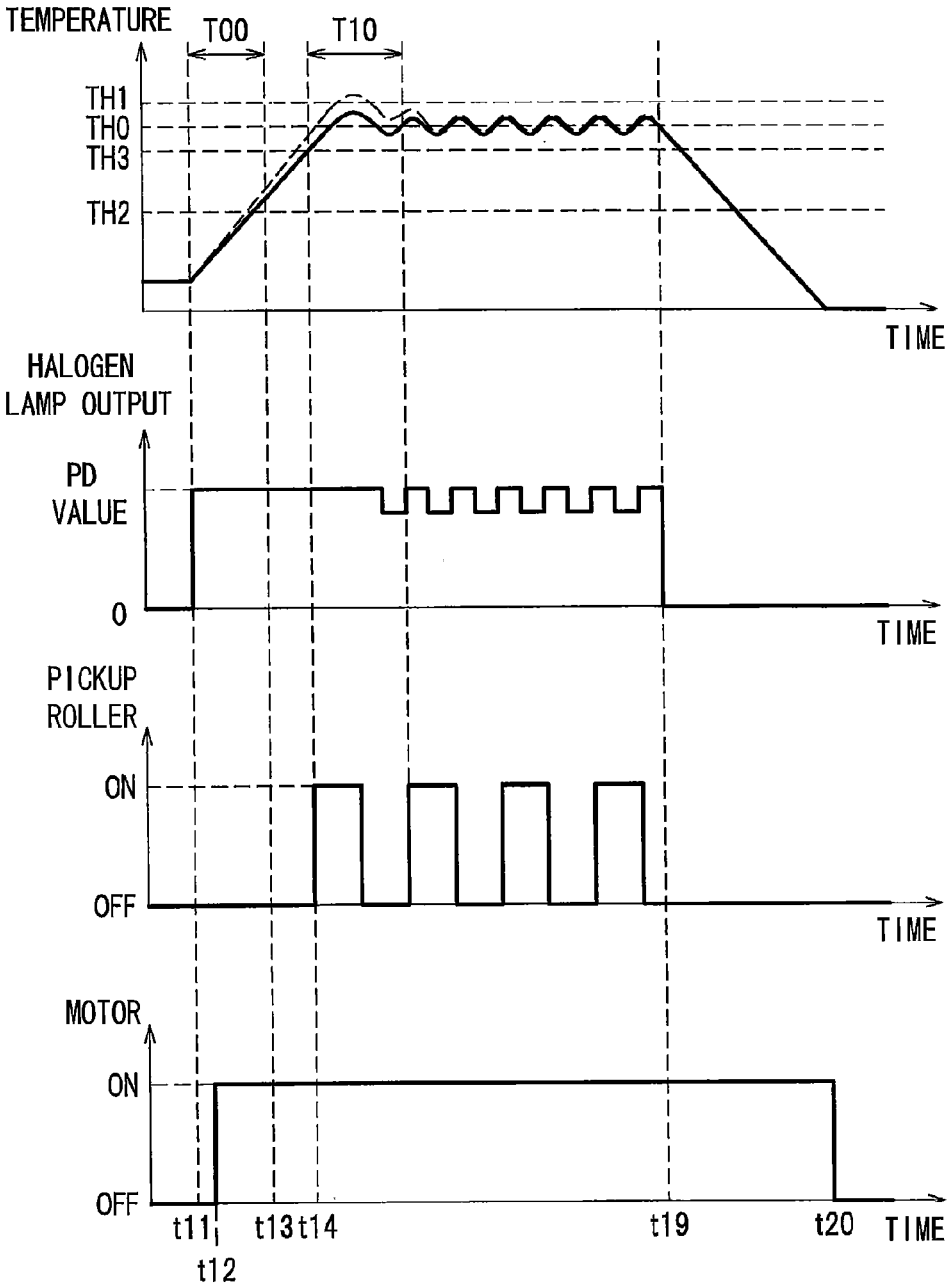
FIG. 7 is a time chart of each parameter when a temperature of an end portion of an endless belt is larger than a second temperature and lower than a third temperature after a predetermined time has elapsed from a reception of a printing command for printing a plurality of sheets having a width lager than a predetermined width.
Figure 8:
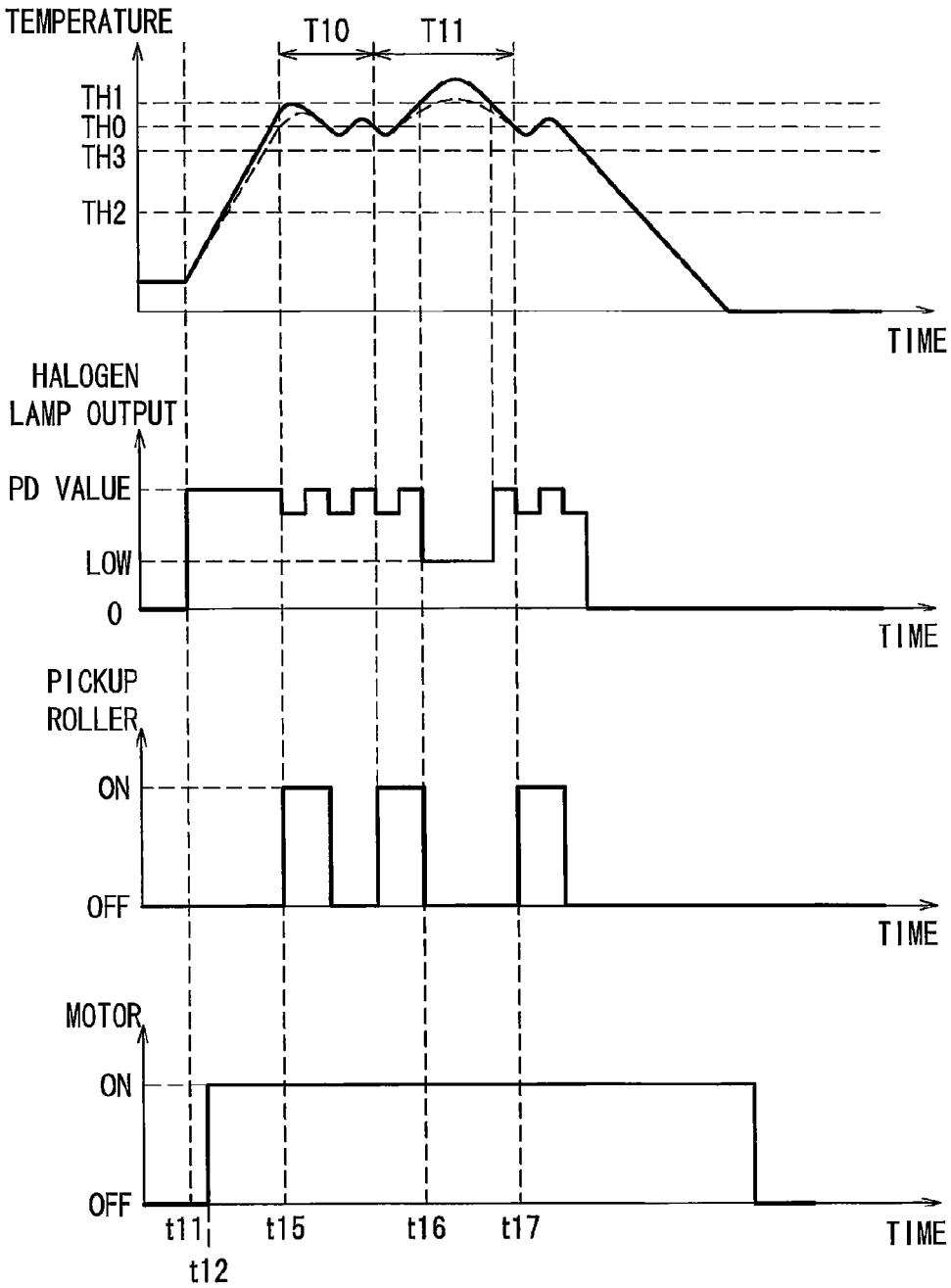
FIG. 8 is a time chart of each parameter when a second mode is performed during a printing control based on a printing command for printing a plurality of sheets having a width smaller than the predetermined width.
Figure 9:
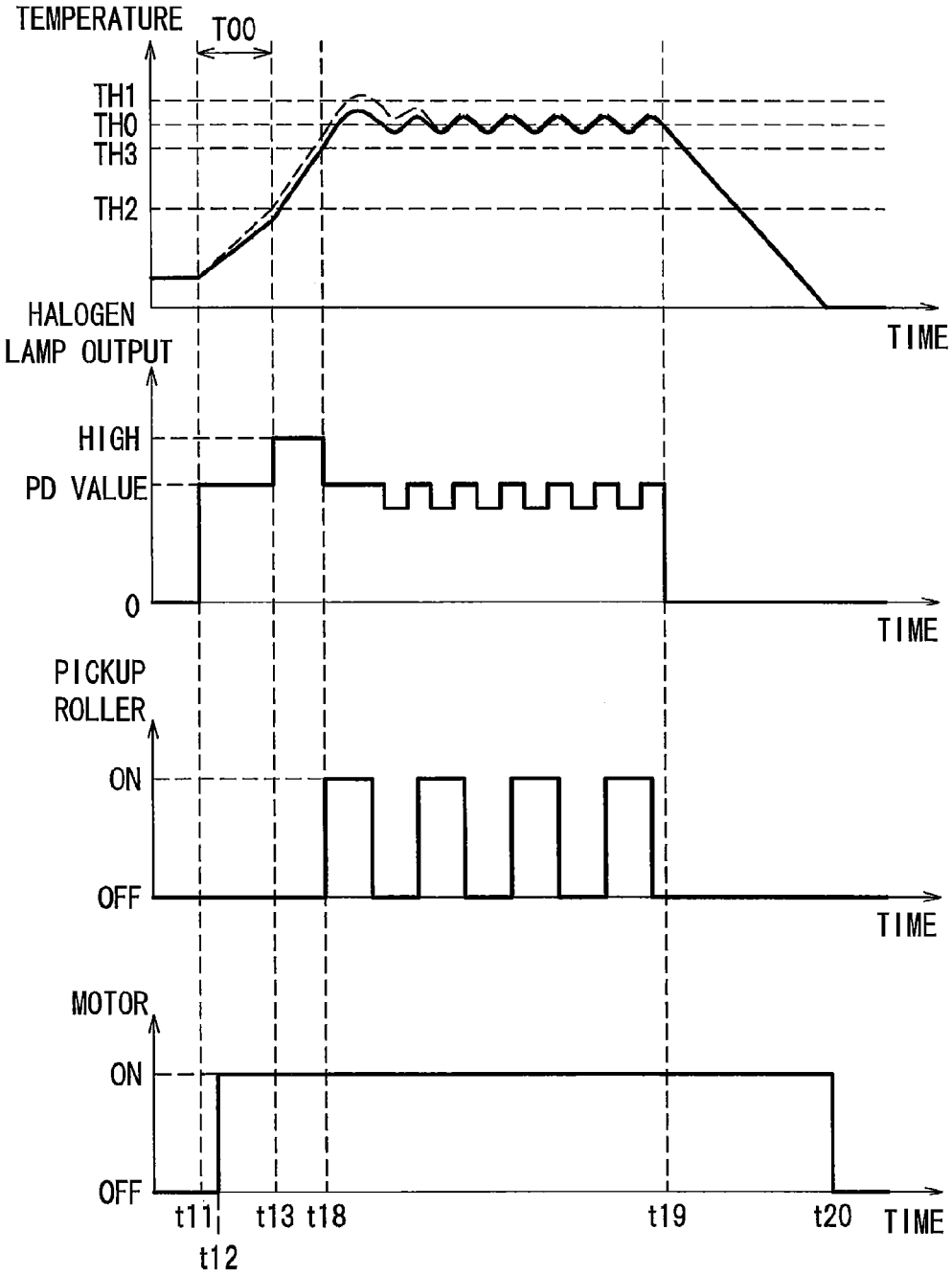
FIG. 9 is a time chart of each parameter when the temperature of the end portion is smaller than or equal to the second temperature after the predetermined time has elapsed from the reception of the printing command for printing a plurality of sheets having a width lager than the predetermined width.

With reference to FIG. 7, changes of each parameter over time will be described in a state where the end-portion temperature TS is larger than the second temperature TH2 and lower than the third temperature TH3 after the predetermined time T00 of time has passed since the control device 300 receives the print command for printing a plurality of sheets 51 having a width larger than or equal to the predetermined width W. In FIGS. 7 to 9, the end-portion temperature TS is indicated by solid line, and the center temperature TC by dashed line.

When the control device 300 receives the print command (time t11), the halogen lamp 120 is turned ON and the output of the halogen lamp 120 is set to a predetermined value (PD value), and subsequently the motor 400 is turned ON (time t12). When the predetermined time T00 has elapsed from time t11 (time t13), the output of the halogen lamp 120 is maintained at the predetermined value if the end-portion temperature TS is larger than the second temperature TH2. If the end-portion temperature TS is lower than the third temperature TH3, the conveyance of the sheet 51 by the pickup roller 52 is suspended until the end-portion temperature TS reaches the third temperature TH3 (time t13 to t14). The end-portion temperature TS and the center temperature TC gradually rise due to the constant output of the halogen lamp 120.

After the end-portion temperature TS reaches the third temperature TH3 (time t14), the pickup roller 52 conveys the sheets 51 at the first intervals T10 in the first mode. The control device 300 controls the halogen lamp 120 to maintain the center temperature TC at the target temperature TH0 by adjusting the output of the halogen lamp 120 from time t14 to time t19. After the print control process comes to an end (time t19), the halogen lamp 120 is turned OFF, and thereafter the motor 400 is turned OFF (time t20).

With reference to FIG. 8, changes of each parameter over time will be described when the control device 300 sets the print mode to the second mode during the print control process based on print command for printing a plurality of sheets 51 having a width smaller than the predetermined width W.

If the end-portion temperature TS is lower than the first temperature TH1 after the print command is received at time t11 and the center temperature TC reaches the target temperature TH0, the control device 300 performs the first mode (time t15). In this case, the sheets 51 are conveyed at the first intervals T10. Then, if the end-portion temperature TS becomes larger than or equal to the first temperature TH1 (time t16), the output of the halogen lamp 120 is set to low, and the control device 300 set the print mode to the second mode. At this time, no sheets 51 are conveyed during the second interval T11 longer than the first interval T10, while the motor 400 has continuously driven. As a result, the rotation of the fusing belt 110 stirs the air, thereby dispersing the heat in the end portion thereof. Furthermore, as the output of the halogen lamp 120 becomes smaller, the end-portion temperature TS and the center temperature TC gradually fall.

Then, at an appropriate timing during the second interval T11, the process returns to the control of the output of the halogen lamp 120 based on the center temperature TC (time t17). After that, as in the case of FIG. 7, the print control process comes to an end.

With reference to FIG. 9, changes of each parameter over time will be described when the end-portion temperature TS is lower than or equal to the second temperature TH2 after the predetermined time T00 has elapsed since the control device 300 receives the print command for printing a plurality of sheets 51 having a width larger than or equal to the predetermined width W.

If the end-portion temperature TS is lower than or equal to the second temperature TH2 after the predetermined time T00 of time has elapsed since the print command is received, the control process is performed based on the end-portion temperature TS, and the output of the halogen lamp 120 is set to high (time t13). In response to increasing the output of the halogen lamp 120, an increase ratio of the end-portion temperature TS and the center temperature TC, i.e., slope of the temperatures, gradually rise rather than before time t13. After the end-portion temperature TS reaches the third temperature TH3 (time t18), the process returns to the control of the output of the halogen lamp 120 based on the center temperature TC, e.g., the output of the halogen lamp 120 returns to the predetermined value, and then the conveyance of the sheets 51 starts. After that, as in the case of FIG. 7, the print control process comes to an end.

According to those described above, the present embodiment can achieve the following advantageous effects.

The side thermistors 210 are positioned facing the end portions of the outer peripheral surface 110B of the fusing belt 110, the end-portion temperature TS can be precisely detected. Moreover, the center thermistor 180 provided at the internal space of the fusing belt 110, thereby accurately detecting the temperature of the internal space. Moreover, the center thermistor 180 is positioned at the internal space of the fusing belt 110, thereby accurately detecting the temperature of the internal space of the fusing belt 110.

The center thermistor 180 can accurately detect the temperature of the nip plate 130. The control device 300 determines that the edge overheat occurs at the end portions of the outer peripheral surface 110B of the fusing belt 110 based on the side thermistor 210 positioned outside of the fusing belt 110, which can suppress the effect of the heat generated on the outer peripheral surface 110B on the pressure roller 150.

If the control device 300 determines that the temperature obtained from at least one of the side thermistors 210 is larger than or equal to the first temperature TH1, then the control device 300 determines that the edge overheat occurs and decreases the output of the halogen lamp 120. Therefore, this configuration can prevent an excessive rise in temperature in the end portions of the fusing belt 110.

If the control device 300 determines that the edge overheat occurs, the conveyance timing of the sheets 51 is delayed. Therefore, the heat at the end portions of the fusing belt 110 can be transferred to the central portion thereof before the subsequent sheet 51 is conveyed.

If the control device 300 determines that the edge overheat occurs, the rotation of the fusing belt 110 has been continued. The rotation of the fusing belt 110 agitates the air, dispersing the heat. Therefore, the heat in the internal space of the end portions of the fusing belt 110 can be reduced during the process of not feeding the sheets 51.

If the end-portion temperature TS on the outer peripheral surface 110B of the fusing belt 110 is low after the predetermined time T00 has elapsed since the halogen lamp 120 is turned ON, the control device 300 increases the output of the halogen lamp 120. Therefore, when the sheet 51 having a width larger than or equal to the predetermined width W is printed, the end-portion temperature TS on the outer peripheral surface 110B of the fusing belt 110 can easily become a suitable temperature, thereby improving an image quality.

If the end-portion temperature TS on the outer peripheral surface 110B of the fusing belt 110 is low, no sheets 51 are conveyed. Therefore, when the sheet 51 having a width larger than or equal to the predetermined width W is printed, the end-portion temperature TS on the outer peripheral surface 110B of the fusing belt 110 can easily become a suitable temperature, thereby improving an image quality.

While the invention has been described in detail with reference to the embodiment thereof, it would be apparent to those skilled in the art that various changes and modifications may be made therein without departing from the spirit of the invention. The same components as those in the above embodiment are represented by the same reference symbols, and will not be described again in the description below.

Figure 10A:
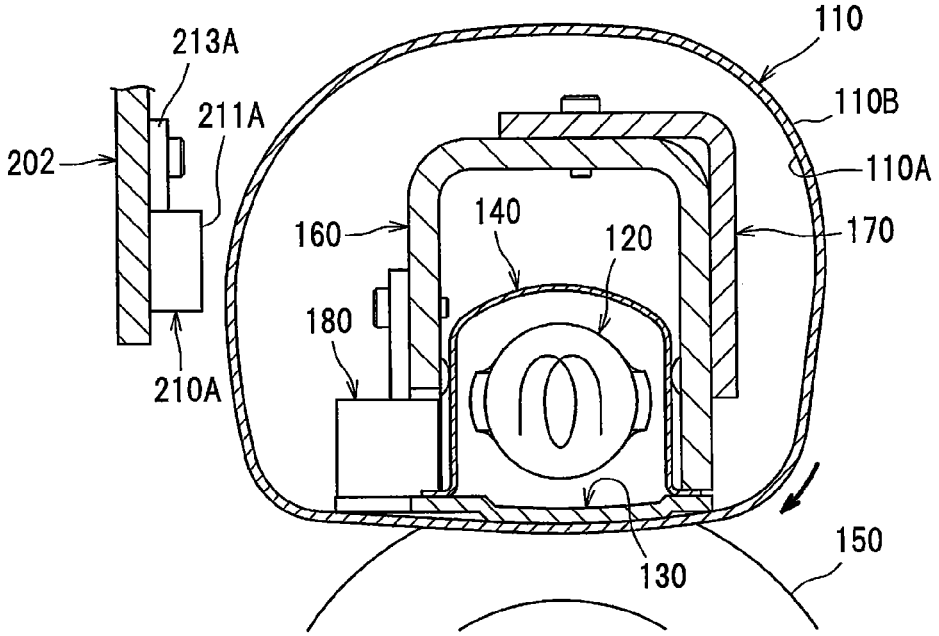
FIG. 10A is a cross-sectional view of a heat fixing device according to a first modification of the embodiment of the invention.

According to the above embodiment, the pair of side thermistors 210 is placed on upstream side in the moving-direction of the fusing belt 110 relative to the pressure roller 150. However, the present invention is not limited to this configuration. For example, as shown in FIG. 10A, a fixing frame 202 extends rearward of the fusing belt 110. A pair of side thermistors 210A may be placed on downstream side in the moving-direction of the fusing belt 110 relative to the pressure roller 150. The pair of side thermistors 210A has an upper portion provided with a fixing rib 213A fixed to the rear wall of the fixing frame 200 with a screw. Each side thermistor 210A has a front surface as a temperature detection surface 211A configured to detect a temperature of the outer peripheral surface 110B of the fusing belt 110.

Figure 10B:
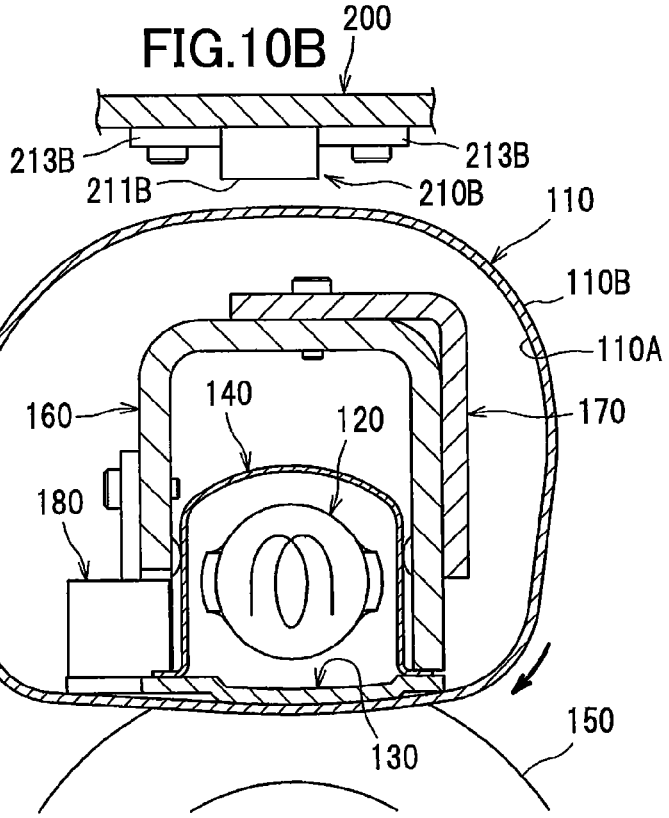
FIG. 10B is a cross-sectional view of a heat fixing device according to a second modification of the embodiment of the invention.

Alternatively, as shown in FIG. 10B, a pair of side thermistors 210B may be placed on the opposite side of the nip N (pressure roller 150) with respect to the fusing belt 110. The pair of side thermistors 210B has both end portions each provided with a fixing rib 213B fixed to the upper wall of the fixing frame 200 with screws. The pair of side thermistors 210B has a bottom surface as a temperature detection surface 211B configured to detect a temperature of the outer peripheral surface 110B of the fusing belt 110.

Figure 11:
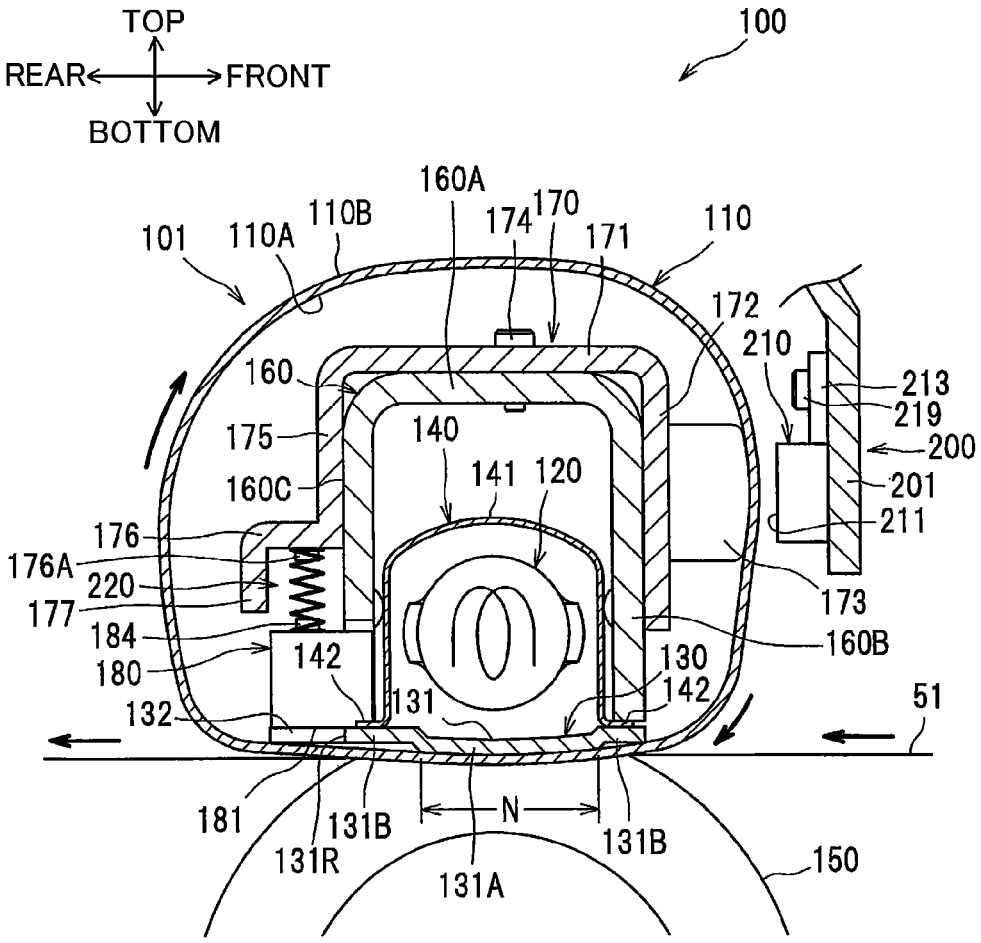
FIG. 11 is a cross-sectional view of a heat fixing device according to a third modification of the embodiment of the invention.

According to the above embodiment, the center thermistor 180 is fixed to the stay 160 with screws 189. However, the present invention is not limited to this configuration. For example, as shown in FIG. 11, a center thermistor 180 may be urged by a compression spring 220 toward the nip plate 130.

A cover member 170 in this configuration includes a rear wall 175, a support wall 176, and an extending wall 177 in addition to the configuration of FIG. 2. The rear wall 175 extends downward from a rear end of the upper-side wall 171, the support wall 176 extends rearward from a lower end of the rear wall 175, and the extending wall 177 extends downward from a rear end of the support wall 176. The compression spring 220 is provided between the support wall 176 and the center thermistor 180 placed on the nip plate 130. The compression spring 220 is held by a projection 176A extending downward from a lower surface of the support wall 176 and a projection 184 extending upward from an upper surface of the center thermistor 180. More specifically, the compression spring 220 is held by the projections 176A and 184 each inserted into the compression spring 220. The compression spring 220 presses the center thermistor 180 toward the nip plate 130. Therefore, the center thermistor 180 can detect the temperature of the nip plate 130.

According to the above embodiment, the control device 300 determines whether the edge overheat occurs based on the end-portion temperature TS obtained by at least one of side thermistors 210. However, the present invention is not limited to this configuration. For example, the control device 300 may be configured to determine whether the center temperature TC acquired from the center thermistor 180 is larger than or equal to a fourth temperature TH4 after the predetermined time T00 has elapsed since the control device 300 controls the halogen lamp 120 to be turned ON, and configured to determine whether the end-portion temperature TS obtained by at least one of side thermistors 210 is larger than or equal to the fourth temperature TH4.

If the control device 300 in this configuration determines that the center temperature TC is not larger than or equal to the fourth temperature TH4 after the predetermined time T00 has elapsed, and that the end-portion temperature TS is larger than or equal to the fourth temperature TH4, then the control device 300 performs a control process to determine that a failure (edge overheat) has occurred. In order to perform such a control process, the control device 300 determines whether the center temperature TC is not larger than or equal to the fourth temperature TH4, and whether the end-portion temperature TS is larger than or equal to the fourth temperature TH4 in step S8 of the flowchart shown in FIGS. 5 and 6. Only if the center temperature TC is not larger than or equal to the fourth temperature TH4, and the end-portion temperature TS is larger than or equal to the fourth temperature TH4, the control device 300 then proceeds to step S9. In other cases, the control device 300 may proceed to step S12.

According to the above embodiment, the control device 300 basically controls the halogen lamp 120 to maintain the output of the halogen lamp 120 constant until the center temperature TC reaches the target temperature TH0. However, the present invention is not limited to this configuration. For example, the control device may compare the center temperature acquired from the center thermistor with the target temperature. The control device may control the halogen lamp to increase the output thereof as a difference between the target temperature and the center temperature becomes larger. In this case, the halogen lamp may be controlled so as to increase or decrease the output thereof by changing the target temperature of the halogen lamp.

According to the above embodiment, the side thermistors 210 are positioned facing the right and left end portions of the outer peripheral surface 110B of the fusing belt 110. Instead, a side thermistor 210 may be positioned facing one of end portions of the outer peripheral surface 110B of the fusing belt 110. Moreover, the pair of side thermistors 210 is located outside of the maximum paper width W1 in the right-left direction. Instead, the pair of the side thermistors may be placed inside of the maximum paper width W1 and outside of the minimum paper width W2 in the right-left direction.

According to the above embodiment, the halogen lamp 120 is illustrated as one example of a heater. However, the present invention is not limited to this configuration. For example, the heater may be an IH (Induction Heating) heater or a ceramic heater. In this case, the IH heater is a device that does not generate heat by itself but uses an electromagnetic induction heating method to heat the metallic fusing belt and the nip plate.

According to the above embodiment, the first intervals T10 and the second intervals T11 are defined as time. Instead, for example, a distance between sheets may be employed.

According to the above embodiment, the thermostat is illustrated as an overheat prevention member. However, the present invention is not limited to this configuration. For example, a fuse may be used.

According to the above embodiment, the pressure roller 150 is illustrated as one example of a rotation member. However, the present invention is not limited to this configuration. For example, a belt-like member may be used.

According to the above embodiment, the nip plate 130 is illustrated as a nip member. However, the present invention is not limited to this configuration. For example, a thick member that is not a plate may be used as the nip member.

According to the above embodiment, the present invention is applied to the color laser printer 1. However, the present invention is not limited to this configuration. The present invention may be applied to other image formation devices, such as copying devices or multifunctional devices.

According to the above embodiment, sheets 51, such as cardboard, postcards, or thin paper, are illustrated as recording sheets. However, the present invention is not limited to those. For example, OHP sheets may be used.

According to the above embodiment, the control device 300 includes single CPU configured to perform the processes of FIGS. 5 and 6. However, the present invention is not limited to this configuration. The control device may include a plurality of CPUs configured to perform the processes of FIGS. 5 and 6, or may include a hardware circuit, such as ASIC (Application Specific Integrated Circuit) configured to perform the processes of FIGS. 5 and 6. The control device may include a CPU and a hardware circuit each configured to perform the processes of FIGS. 5 and 6.

What is claimed is:

1. An image forming apparatus comprising:

an endless belt elongated in a longitudinal direction, the endless belt having a center portion and end portions in the longitudinal direction, and defining an internal space therein and an outer peripheral surface;

a heater elongated in the longitudinal direction and configured to heat the endless belt;

a rotation member configured to form a nip region between the endless belt and the rotation member, the endless belt being configured to move in a moving direction at the nip region, the rotation member and the endless belt being configured to convey a recording sheet in a conveyance direction;

a first temperature sensor positioned at the center portion and in the internal space;

a second temperature sensor positioned at one of the end portions and facing the outer peripheral surface;

a thermostat;

a cover member positioned in the internal space; and a plurality of ribs provided on the cover member, aligned in the longitudinal direction, and configured to guide the endless belt, each of the plurality of ribs facing the second temperature sensor in the conveyance direction with the endless belt interposed therebetween, wherein the plurality of ribs includes:

a first rib overlapping with the first temperature sensor when viewed from a first direction perpendicular to the longitudinal direction, wherein a dimension of the first rib in the longitudinal direction is smaller than a dimension of the first temperature sensor in the longitudinal direction;

a second rib overlapping with the second temperature sensor when viewed from a second direction perpendicular to the longitudinal direction, wherein a dimension of the second rib in the longitudinal direction is smaller than a dimension of the second temperature sensor in the longitudinal direction; and a third rib overlapping with the thermostat when viewed from a third direction perpendicular to the longitudinal direction, wherein a dimension of the third rib in the longitudinal direction is less than a dimension of the thermostat in the longitudinal direction.

2. The image forming apparatus according to claim 1, wherein the endless belt further defines an inner peripheral surface, the image forming apparatus further comprising:

a nip member configured to contact the inner peripheral surface of the endless belt; and wherein the rotation member is configured to contact the outer peripheral surface of the endless belt and to sandwich the endless belt between the nip member and the rotation member, wherein the first temperature sensor faces the nip member.

3. The image forming apparatus according to claim 2, wherein the heater is a heating element and is spaced apart from the nip member.

4. The image forming apparatus according to claim 1, wherein the heater is disposed at the internal space to heat the endless belt.

5. The image forming apparatus according to claim 1, further comprising a controller configured to:

receive a first signal from the first temperature sensor;

control the heater based on the first signal;

receive a second signal from the second temperature sensor; and determine whether an edge overheat occurs at the one of the end portions based on the second signal.

6. The image forming apparatus according to claim 5, wherein the controller is configured to:

determine a temperature of the second temperature sensor based on the second signal;

determine whether the temperature of the second temperature sensor is larger than or equal to a first temperature; and determine that the edge overheat occurs if the temperature of the second temperature sensor is larger than or equal to the first temperature.

7. The image forming apparatus according to claim 5, wherein the controller is configured to decrease an output of the heater if the controller determines that the edge overheat occurs.

8. The image forming apparatus according to claim 5, further comprising a conveying mechanism configured to supply the recording sheet to the endless belt, wherein the controller is configured to:

perform one of a first mode for controlling the conveying mechanism to supply the recording sheet at a first interval and a second mode for controlling the conveying mechanism to supply the recording sheet at a second interval longer than the first interval; and perform the second mode if the controller is determined that the edge overheat occurs.

9. The image forming apparatus according to claim 5, further comprising a conveying mechanism configured to supply the recording sheet to the endless belt, wherein the controller decreases an output of the heater and controls the conveying mechanism to stop supplying the recording sheet while the endless belt circularly moves.

10. The image forming apparatus according to claim 5, further comprising a conveying mechanism configured to supply the recording sheet to the endless belt, wherein the controller is configured to:

determine whether a width of the recording sheet is larger than or equal to a predetermined width;

determine a temperature of the second temperature sensor based on the second signal;

determine, if the width of the recording sheet is larger than or equal to the predetermined width, whether the temperature of the second temperature sensor is less than or equal to a first temperature less than a fixing temperature at which an image on the recording sheet is fixed thereon; and increase an output of the heater if the temperature of the second temperature sensor is less than the first temperature.

11. The image forming apparatus according to claim 5, further comprising a conveying mechanism configured to supply the recording sheet to the endless belt, wherein the controller is configured to:

determine whether a width of the recording sheet is larger than or equal to a predetermined width;

determine a temperature of the second temperature sensor based on the second signal;

determine, if the width of the recording sheet is larger than or equal to the predetermined width, whether the temperature of the second temperature sensor is larger than or equal to a first temperature less than a fixing temperature at which an image on the recording sheet is fixed thereon; and control the conveying mechanism to start to supply the recording sheet if the temperature of the second temperature sensor is larger than or equal to the first temperature.

12. The image forming apparatus according to claim 5, wherein the controller is configured to:

determine a temperature of the first temperature sensor based on the first signal;

determine a temperature of the second temperature sensor based on the second signal;

determine, after a predetermined time has elapsed since the heater is turned on, whether the temperature of the first temperature sensor is larger than or equal to a first temperature;

determine, after the predetermined time has elapsed since the heater is turned on, whether the temperature of the second temperature sensor is larger than or equal to the first temperature; and determine that the edge overheat occurs if the temperature of the first temperature sensor is not larger than or equal to the first temperature and the temperature of the second temperature sensor is larger than or equal to the first temperature.

13. The image forming apparatus according to claim 5, wherein the controller is configured to control the heater based on the first signal and the second signal.

14. The image forming apparatus according to claim 13, wherein the controller is configured to:

determine a temperature of the second temperature sensor based on the second signal;

determine whether the temperature of the second temperature sensor is less than or equal to a first temperature; and increase an output of the heater if the temperature of the second temperature sensor is less than or equal to the first temperature.

15. The image forming apparatus according to claim 14, wherein the controller is configured to:

determine a temperature of the first temperature sensor based on the first signal;

compare the temperature of the first temperature sensor with a second temperature;

increase an output of the heater as a difference between the temperature of the first temperature sensor and the second temperature becomes larger; and increase the second temperature if the temperature of the second temperature sensor is less than or equal to the first temperature.

16. The image forming apparatus according to claim 14, wherein the controller is configured to increase a duty ratio of pulse current supplied to the heater if the temperature of the second temperature sensor is less than or equal to the first temperature.

17. The image forming apparatus according to claim 1, wherein the second temperature sensor is spaced apart from the endless belt.

18. The image forming apparatus according to claim 1, wherein the second temperature sensor contacts the endless belt.

19. The image forming apparatus according to claim 1, wherein the endless belt defines a maximum width in the longitudinal direction, the image forming apparatus configured to print a recording sheet having a width less than or equal to the maximum width, and wherein the second temperature sensor is disposed outside of the maximum width.

20. A heat fixing device comprising:

a roller rotatable about a rotational axis extending in an axial direction;

an endless belt having a center portion and end portions in the axial direction, the endless belt defining an internal space therein, an inner peripheral surface, and an outer peripheral surface;

a nip member configured to contact the inner peripheral surface of the endless belt, the nip member and the roller being configured to pinch the endless belt therebetween, the endless belt and the roller being configured to form a nip region therebetween, and the endless belt being configured to move in a moving direction at the nip region, the roller and the endless belt being configured to convey a recording sheet in a conveyance direction;

a first temperature sensor positioned at the center portion and in the internal space;

a second temperature sensor positioned at one of the end portions and facing the outer peripheral surface;

a cover member having a plurality of ribs for guiding the endless belt, the plurality of ribs arranged in a line extending in the axial direction; and a thermostat, wherein the plurality of ribs includes:

a first rib overlapping with the first temperature sensor when viewed from a first direction perpendicular to the axial direction; and a second rib overlapping with the second temperature sensor when viewed from a second direction perpendicular to the axial direction.

21. The heat fixing device according to claim 20, wherein the first temperature sensor is closer to the nip region than the second temperature sensor.

22. The heat fixing device according to claim 20, further comprising a heater opposite to the nip region relative to the nip member, the second temperature sensor being opposite to the nip member relative to the heater.

23. The heat fixing device according to claim 21, wherein the second temperature sensor is disposed at an upstream side relative to the nip region in the conveyance direction.

24. The heat fixing device according to claim 20, wherein the nip member has a first surface contactable with the inner peripheral surface of the endless belt and a second surface opposite to the first surface, and wherein the first temperature sensor contacts the second surface of the nip member, the second temperature sensor being spaced apart from the outer peripheral surface of the endless belt.

25. A heat fixing device comprising:

a heater;

a nip member;

a backup member rotatable about an axis extending in an axial direction;

a circular belt extending around the heater and the nip member, the backup member and the nip member being configured to pinch the circular belt therebetween, the circular belt and the backup member being configured to form a nip region therebetween, the circular belt being configured to move in a moving direction at the nip region, and the circular belt having a center portion and an end portion in the axial direction and having an outer peripheral surface;

a first temperature sensor, the center portion of the circular belt extending around the first temperature sensor;

a second temperature sensor facing the outer peripheral surface of the circular belt, the second temperature sensor being closer to the end portion of the circular belt than to the center portion; and a plurality of ribs arranged in a line extending in the axial direction and arranged to contact an inner peripheral surface of the circular belt, wherein the second temperature sensor overlaps with one of the plurality of ribs when viewed from a direction perpendicular to the axial direction.

26. The heat fixing device according to claim 25, wherein the heater is opposite to the nip region relative to the nip member, the second temperature sensor being opposite to the nip member relative to the heater.

27. The heat fixing device according to claim 25, wherein the backup member and the circular belt are configured to convey a recording sheet in a conveyance direction, and wherein the second temperature sensor is disposed at an upstream side in the conveyance direction relative to the nip region.

28. The heat fixing device according to claim 25, wherein the backup member and the circular belt are configured to convey a recording sheet in a conveyance direction, and wherein the second temperature sensor is disposed at a downstream side in the conveyance direction relative to the nip region.

29. The heat fixing device according to claim 25, wherein the nip member has a first surface contactable with the inner peripheral surface of the circular belt and a second surface opposite to the first surface, and wherein the first temperature sensor contacts the second surface of the nip member, the second temperature sensor being spaced apart from the outer peripheral surface of the circular belt.

30. The heat fixing device according to claim 25, further comprising a thermostat, the circular belt extending around the thermostat.

31. The heat fixing device according to claim 30, wherein the thermostat is closer to the first temperature sensor than to the second temperature sensor.

32. The heat fixing device according to claim 25, wherein the first temperature sensor is closer to the heater than the second temperature sensor when viewed from the axial direction.

33. The heat fixing device according to claim 32, further comprising a reflection member configured to reflect radiation heat from the heater, wherein the first temperature sensor is closer to the reflection member than the second temperature sensor when viewed from the axial direction.

34. The heat fixing device according to claim 33, further comprising a stay, wherein the first temperature sensor is closer to the stay than the second temperature sensor when viewed from the axial direction.

35. The heat fixing device according to claim 34, wherein the stay has a U shape.

* * * * *